US007104102B2

(12) United States Patent
Del Fabro et al.

(10) Patent No.: US 7,104,102 B2
(45) Date of Patent: Sep. 12, 2006

(54) BENDING MACHINE FOR PROFILES SUCH AS REINFORCEMENT ROUND PIECES OR SIMILAR

(75) Inventors: Giorgio Del Fabro, Tricesimo (IT); Marcello Del Fabro, Tavagnacco (IT)

(73) Assignee: M.E.P. Macchine Elettroniche Piegatrici SpA, Reana Del Rojale (IT)

( * ) Notice: Subject to any disclaimer, the term of this patent is extended or adjusted under 35 U.S.C. 154(b) by 28 days.

(21) Appl. No.: 10/497,144

(22) PCT Filed: Nov. 25, 2002

(86) PCT No.: PCT/IB02/04920

§ 371 (c)(1),
(2), (4) Date: May 28, 2004

(87) PCT Pub. No.: WO03/045603

PCT Pub. Date: Jun. 5, 2003

(65) Prior Publication Data

US 2005/0076693 A1 Apr. 14, 2005

(30) Foreign Application Priority Data

Nov. 30, 2001 (IT) ..... UD2001A0197

(51) Int. Cl.
*B21D 11/12* (2006.01)

(52) U.S. Cl. ..... 72/294; 72/307; 72/319; 72/387

(58) Field of Classification Search ..... 72/294, 72/319, 386, 387, 149, 338, 339, 330, 331, 72/307

See application file for complete search history.

(56) References Cited

U.S. PATENT DOCUMENTS

| | | | | | |
|---|---|---|---|---|---|
| 3,057,042 | A | * | 10/1962 | Lawson | 72/333 |
| 3,193,171 | A | * | 7/1965 | Johnson et al. | 228/13 |
| 4,489,584 | A | * | 12/1984 | Gall et al. | 72/327 |
| 5,285,671 | A | | 2/1994 | Del Fabro et al. | |
| 5,966,979 | A | | 10/1999 | Del Fabro et al. | |
| 6,158,264 | A | * | 12/2000 | Mizukawa | 72/294 |

FOREIGN PATENT DOCUMENTS

| | | |
|---|---|---|
| EP | 0537496 | 4/1993 |
| EP | 0538595 | 4/1993 |
| EP | 0875309 | 11/1998 |
| EP | 0882529 | 12/1998 |
| FR | 2704784 | 11/1994 |

* cited by examiner

*Primary Examiner*—Daniel C. Crane
(74) *Attorney, Agent, or Firm*—Stevens, Davis, Miller & Mosher, LLP

(57) ABSTRACT

Bending machine (10) to obtain shaped elements from pre-cut profiles (11), equipped with a drawing assembly (14) which draws the profiles (11), first shearing means (13) arranged downstream of the drawing assembly (14) and bending means (12) arranged downstream of the first shearing means (13). Downstream of the bending means (12) are arranged second shearing means (15) to eliminate the terminal segments of the profiles (11) corresponding to the difference between the linear development of the shaped element to be produced and the length of the pre-cut profiles (11).

17 Claims, 2 Drawing Sheets

BENDING MACHINE FOR PROFILES SUCH AS REINFORCEMENT ROUND PIECES OR SIMILAR

This application is a §371 National Stage Application of International Application No. PCT/IB02/04920, filed on 25 Nov. 2002, claiming the priority of Italian Patent Application No. UD2001A000197 filed on 30 Nov. 2001.

FIELD OF THE INVENTION

The invention concerns a bending machine for profiles, such as for example reinforcement round pieces or similar, comprising at least a drawing assembly, first shearing means arranged downstream of the drawing assembly, bending means and second shearing means arranged downstream of said bending means.

The invention is applied advantageously, although not exclusively, to bending machines comprising at least two drawing assemblies, respectively one upstream and one downstream of the bending means, which allow to make leading end bends and trailing end bends by making the profile advance alternately in one direction and the other with respect to the nominal axis on which it lies.

The invention is applied for bending and shaping straight bars, already sheared to size, either single or in bundles, and able to make brackets or other shaped reinforcement elements. The invention, selectively using the second shearing means located downstream of the bending means, allows to eliminate off-cuts produced during working and/or parts in excess of the development of the shaped element, and to discharge them to a position which is not dangerous for the worker and for the other operating assemblies of the machine.

BACKGROUND OF THE INVENTION

There are known bending machines for profiles, such as reinforcement round pieces or similar, either single or in bundles, wherein shearing means, usually consisting of a shears arranged downstream of the drawing assembly and upstream of the bending means, are able to shear said profiles.

Such bending machines, when they are working bars pre-cut to size, have the problem of discharging possible excess parts and off-cuts produced during working, deriving from the difference between the length of the bar and the linear development of the bracket formed.

To be more exact, once the profile has been shaped so as to form a bracket or other shaped profile, a terminal segment of the bar can be in excess with respect to the linear development of the shaped element, and remain gripped on the drawing assembly after shearing has been completed.

This sheared segment, or off-cut, must then be discharged from the machine and particularly from the drawing means in order to start a new production cycle.

In order to discharge said off-cut, a conventional solution provides ejector rollers downstream of the drawing assembly; these rollers are able to intervene after shearing has been carried out, so as to expel the off-cut from the machine, thus freeing the drawing assembly.

However, with this solution, there is the risk that the discharged off-cut can interfere with the bending means arranged immediately downstream of the shears, or with other operating assemblies which can be present on the bending machine, thus compromising the correct functioning thereof. Moreover, this conventional solution does not guarantee sufficient safety for the operator, since off-cuts discharged in this way can hit him.

It often happens, therefore, that the operator has to intervene manually to remove the off-cuts from the drawing assembly, with consequent waste of time and dangers to his safety.

The Applicant has devised and embodied this invention to overcome this shortcoming of the state of the art, and to obtain further advantages.

SUMMARY OF THE INVENTION

The invention is set forth and characterized essentially in the main claim, while the dependent claims describe other innovative characteristics of the invention.

The purpose of the invention is to achieve a bending machine for profiles, for example reinforcement round pieces or similar, which will allow to easily discharge possible off-cuts, even very small ones, deriving from the difference between the length of the profile and the linear development of the shaped element to be produced.

Another purpose of the invention is to reduce to a minimum the risk that such off-cuts might hit the operator as they are discharged.

The bending machine for profiles wherein the invention is applied preferentially comprises a drawing assembly able to draw said profiles, first shearing means arranged downstream of the drawing assembly, bending means arranged downstream of said first shearing means and second drawing means arranged downstream of the bending means and able to act on the profile to make the trailing end bends.

According to a characterizing feature of the invention, second shearing means, for example a shears, are arranged between the bending means and said second drawing means, and are able to act on the profile being worked so as to eliminate in advance an excess segment when there is a known difference between the length of the pre-cut bar, or segment of bar, and the linear development of the shaped element to be formed.

Using said second shearing means, the bar can be made to advance for its whole extension beyond the bending means, then is sheared at the end to remove the part exceeding the linear development of the shaped element to be formed, and then moved in the opposite direction, with respect to the first advance movement, by means of the second drawing means, in order to make the desired trailing end bends.

The second drawing means can be either with pairs of rollers or, according to a variant, of the type with a gripper equipped with alternate movement.

The first drawing means can be either of the type with pairs of rollers or of the type with a gripper, or a combined gripper and roller. In another solution, at least part of the first drawing means is movable from a first position next to the bending means to a second position distant from said bending means, in order to allow the user to load the profiles in a position far from the bending means.

According to a variant of the invention, the bending means, the second shearing means and at least part of the second drawing means are able to translate, after the profile has been sheared to size by the first shearing means, to at least a working position off-set with respect to the nominal axis of the first advance movement defined by the first drawing means and the first shearing means.

This off-set working position lies, in the preferential embodiment, on an axis substantially parallel with respect to the nominal axis of the first advance movement of the profile. This off-set position can be achieved by translating said assemblies upwards or downwards with respect to said nominal axis.

In this off-set position, the second drawing means move the profile in the opposite direction to the first advance movement and cooperate with the bending means to make the trailing end bends and shapes.

With the machine according to the invention it is possible to cut the off-cuts without the intervention of ejector rollers positioned for this purpose in proximity to the bending means, thus avoiding the installation of such rollers, and also the risk that the discharge of said off-cuts might be dangerous for the operator.

Moreover, it is possible to eliminate even minimal excess parts, allowing to obtain shaped elements with the desired development starting from pre-cut bars without generating off-cuts produced during working.

BRIEF DESCRIPTION OF THE DRAWINGS

These and other characteristics of the invention will become clear from the following description of some preferential forms of embodiment, given as a non-restrictive example, with reference to the attached drawings wherein.

DETAILED DESCRIPTION OF SOME PREFERENTIAL EMBODIMENTS

Figure 1:
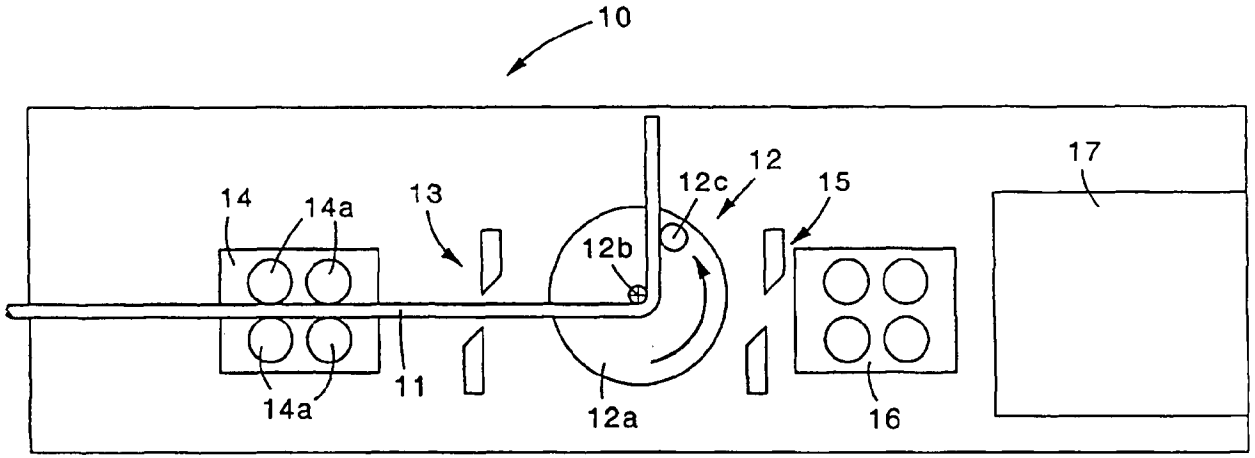
FIG. 1 is a schematic view of a bending machine for profiles according to the invention in a first form of embodiment.

With reference to the attached figures, a bending machine 10 for profiles 11 according to the invention comprises a drawing assembly 14, first shearing means 13, bending means 12 of the type with a rotary disk to bend/shape the profile 11, second shearing means 15 arranged downstream of the bending means 12 and a second drawing assembly 16 arranged downstream of the second shearing means 15.

The bending machine 10 is suitable to operate on straight bars pre-cut to size, of a length for example of 12 m, single or in bundles, supplied from a store and/or fed by a suitable automatic, semi-automatic or manual feeder.

In the solution shown here, the machine 10 also comprises, downstream of the second drawing assembly 16, a retaining element 17 of the type with a limit plate able to prevent the bent segments of the profile 11 from lifting with respect to an ideal plane.

The bending means 12 comprise a plate 12*a* mounted rotatable around a contrasting pin 12*b*. On the upper surface and in a substantially peripheral zone of the plate 12*a* there is a bending pin 12*c*, by means of which it is possible to achieve, as shown, the bending of the profile 11.

The first shearing means 13 comprise a shears and act on the profile 11 after it has been made to advance completely through the bending means 12. Normally, in order to make the shaped element, the profile 11 is made to advance for a desired segment beyond the bending means 12, and then the leading end bend is performed (FIG. 1). Then, the profile is made to advance for its whole length thanks to the action of the second drawing assembly 16, it is sheared by the first shearing means 13 and then moved in the opposite direction in order to perform the trailing end bends which form the shaped element.

In the bending machine 10 according to the invention, the second shearing means 15 are suitable to act on the profile 11 after it has advanced beyond the bending means 12 to eliminate an excess segment of trailing end, so that there are no off-cuts produced during working after the operation to form the shaped element has been completed.

Said second shearing means 15 allow to eliminate even minimal excess parts, after the difference between the linear development of the shaped element and the length of the bar 11 has been calculated, and to discharge said excess parts into a position which is not dangerous for the operator.

Figure 2:
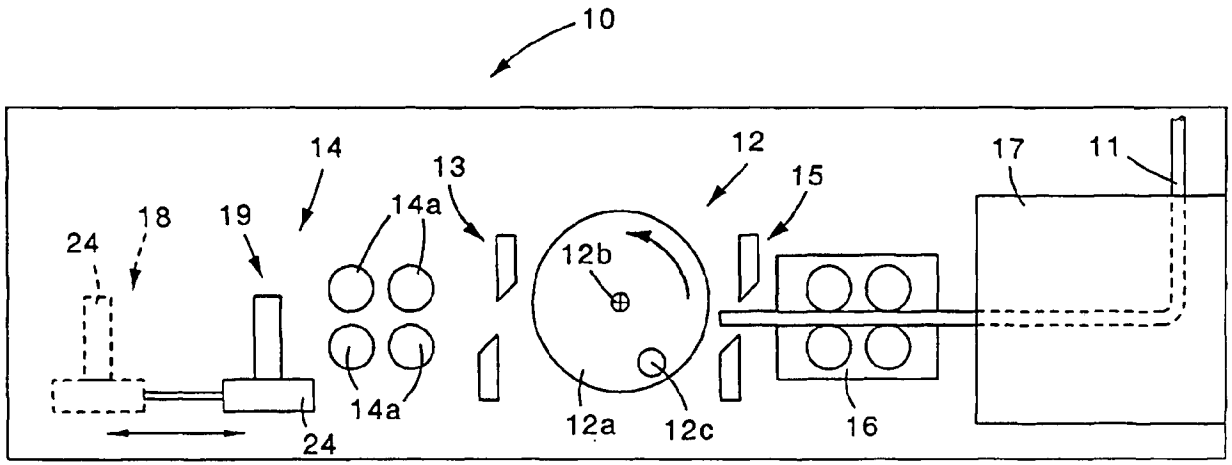
FIG. 2 shows a second form of embodiment of the bending machine according to the invention.

In the embodiment shown in FIG. 1, the first drawing assembly 14 is of the type with pairs of rollers 14*a*, whereas in the embodiment shown in FIG. 2 the first drawing assembly 14 comprises pairs of rollers 14*a* and a gripper 24 movable from a first loading position 18, distant from the bending means 12, to a second drawing position 19 in proximity to said bending means 12.

Figure 3:
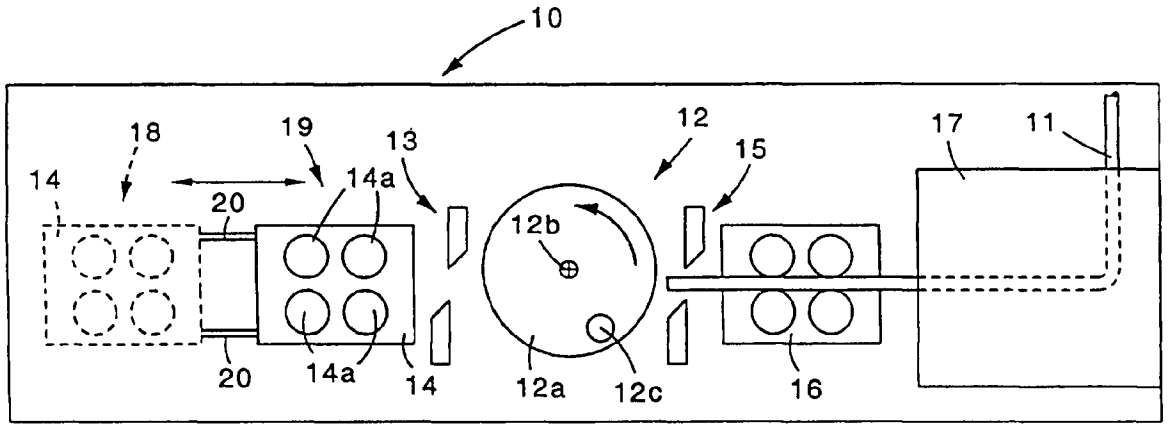
FIG. 3 shows a third form of embodiment of the bending machine according to the invention.

In the embodiment shown in FIG. 3, the first drawing assembly 14 comprises pairs of rollers 14*a* movable on rails 20 between said two positions, loading 18 and drawing 19.

Figure 4:
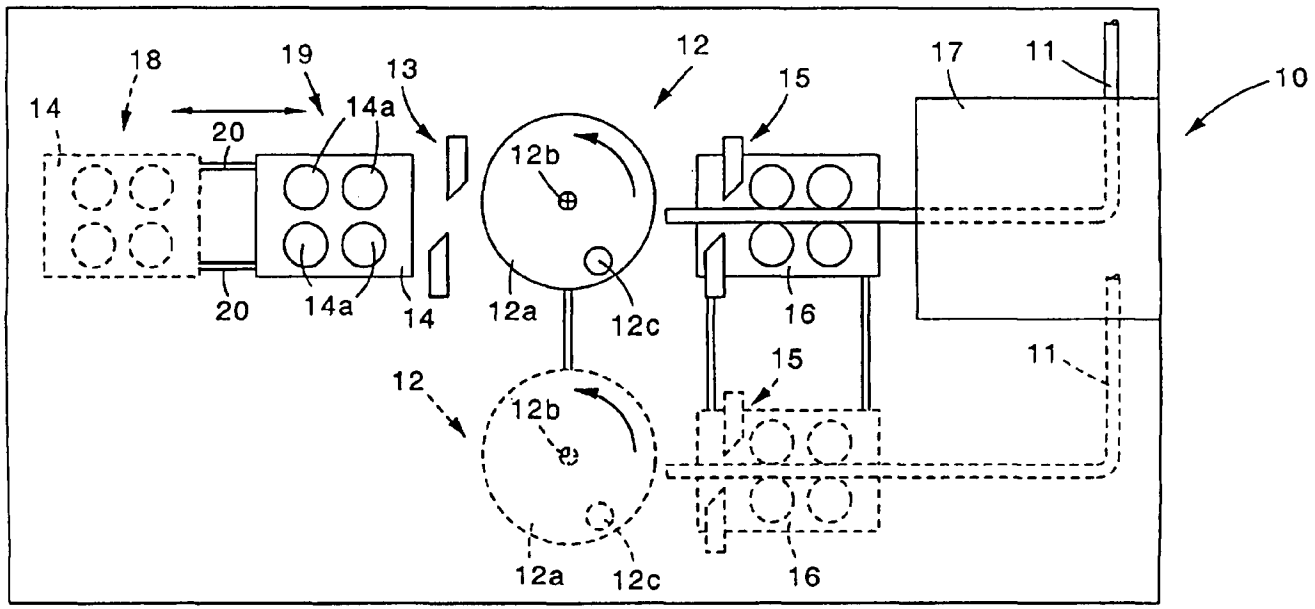
FIG. 4 shows a variant of FIG. 3.

In the variant shown in FIG. 4, the bending means 12, the second shearing means 15 and the second drawing means 16 are movable on respective guides to move from a first position to feed the profile 11 forwards, substantially on axis with the first drawing assembly 14 and the bending means 12, to a second position off-set with respect thereto.

From this position, after said second shearing means 15 have possibly been activated to eliminate the excess trailing ends, it is possible to start the procedure to make the trailing end bends in order to form the shaped element.

It is clear that modifications and/or additions of parts may be made to the bending machine 10 as described heretofore, without departing from the spirit and scope of this invention.

For example, the second drawing assembly 16 can consist of a gripper, or a combination of grippers and rollers, instead of the rollers alone as in the attached figures.

It is also clear that, although the present invention has been described with reference to specific examples, a skilled person shall certainly be able to achieve many other equivalent forms of bending machine for profiles, all of which shall come within the field and scope of the present invention.

The invention claimed is:

1. Bending machine to obtain shaped elements from pre-cut profiles, comprising at least a first drawing assembly able to draw said profiles, first shearing means for shearing the profile to size arranged downstream of said first drawing assembly and bending means arranged downstream of said first shearing means, said bending means for forming a bend which traverses the entire width of the respective said pre-cut profile, and second shearing means arranged downstream of said bending means and able to eliminate terminal segments of said profiles corresponding to the difference between a linear development of the shaped element to be produced and a length of said pre-cut; and wherein said first drawing assembly comprises pairs of rollers and a movable gripper.

2. Machine as in claim 1, wherein said second shearing means comprise a shears.

3. Machine as in claim 1, wherein said movable gripper is movable from a first loading position to a second drawing position.

4. Machine as in claim 1, wherein said bending means comprises a rotary disk for bending the profile.

5. Bending machine to obtain shaped elements from pre-cut profiles, comprising at least a first drawing assembly able to draw said profiles, first shearing means arranged downstream of said first drawing assembly and bending means arranged downstream of said first shearing means, and second shearing means arranged downstream of said bending means and able to eliminate terminal segments of said profiles corresponding to the difference between a linear development of the shaped element to be produced and a length of said pre-cut profiles, and at least a second drawing assembly arranged downstream of said bending means, wherein said second shearing means are arranged between said bending means and said second drawing assembly.

6. Machine as in claim 5, wherein said second drawing assembly comprises pairs of rollers.

7. Machine as in claim 5, wherein said second drawing assembly comprises an alternately movable gripper.

8. Machine as in claim 5, wherein said second drawing assembly comprises pairs of rollers and a movable gripper.

9. Machine as in claim 5, wherein said first drawing assembly comprises at least a part movable from a first loading position to a second drawing position.

10. Machine as in claim 5, wherein said first drawing assembly comprises pairs of rollers.

11. Machine as in claim 5, wherein said first drawing assembly comprises an alternately movable gripper.

12. Machine as in claim 5, wherein said first drawing assembly comprises pairs of rollers and a movable gripper.

13. Bending machine to obtain shaped elements from pre-cut profiles, comprising at least a first drawing assembly able to draw said profiles, first shearing means arranged downstream of said first drawing assembly and bending means arranged downstream of said first shearing means, and second shearing means arranged downstream of said bending means and able to eliminate terminal segments of said profiles corresponding to the difference between a linear development of the shaped element to be produced and a length of said pre-cut profiles, further comprising at least a second drawing assembly arranged downstream of said bending means, wherein said bending means, said second shearing means and at least part of said second drawing assembly are able to translate, after the profile has been sheared to size by said first shearing means, to at least a working position off-set with respect to a nominal axis of advance defined by the first drawing assembly and the first shearing means.

14. Machine as in claim 13, wherein said off-set working position lies on an axis substantially parallel with respect to said nominal axis of advance.

15. Machine as in claim 13, wherein said second shearing means comprise a shears.

16. Machine as in claim 13, wherein said second shearing means are arranged between said bending means and said second drawing assembly.

17. Machine as in claim 16, wherein said second drawing assembly comprises pairs of rollers and a movable gripper.

* * * * *